United States Patent [19]

Bonner

[11] Patent Number: 4,732,059

[45] Date of Patent: Mar. 22, 1988

[54] DRIVER FOR REINFORCEMENT BAR CHEMICAL ANCHOR

[75] Inventor: Ben V. Bonner, Bloomfield Hills, Mich.

[73] Assignee: A.T. & G. Company, Farmington Hills, Mich.

[21] Appl. No.: 947,841

[22] Filed: Dec. 30, 1986

[51] Int. Cl.[4] ..... B25B 13/50

[52] U.S. Cl. ..... 81/53.2; 81/90.3

[58] Field of Search ..... 81/53.2, 90.1, 90.3, 81/91.2, 92, 94–96; 279/22, 33, 1 C, 1 SG

[56] References Cited

U.S. PATENT DOCUMENTS

| | | | |
|---|---|---|---|
| 651,306 | 6/1900 | Gabriel | 81/111 |
| 847,251 | 3/1907 | Hodson | 81/111 |
| 1,195,901 | 8/1916 | Barrett | 81/53.2 |
| 1,224,801 | 5/1917 | Sprung | 81/53.2 |
| 1,375,456 | 4/1921 | Hasty | 81/53.2 |
| 2,408,335 | 9/1946 | Oliver et al. | 81/53.2 |
| 2,516,394 | 7/1950 | Keiser | 81/53.2 |
| 2,550,929 | 5/1951 | Keiser | 81/53.2 |
| 2,613,564 | 10/1952 | Walraven et al. | 81/53.2 |
| 2,613,565 | 10/1952 | Saunders | 81/128 |
| 2,613,942 | 10/1952 | Saunders | 81/183 |
| 2,657,014 | 10/1953 | Webster | 81/57.15 |
| 3,604,718 | 9/1971 | Becker | 279/1 SG |
| 3,747,442 | 7/1973 | Rausch | 81/53.2 |
| 4,477,096 | 10/1984 | Wallace et al. | 279/1 C |
| 4,676,125 | 6/1987 | Ardelean | 81/53.2 |

*Primary Examiner*—Frederick R. Schmidt
*Assistant Examiner*—Robert Showalter
*Attorney, Agent, or Firm*—Robert G. Mentag

[57] ABSTRACT

A driver for a construction reinforcement bar for rotatably inserting the bar into a seating position in a drilled hole in rock, masonry, concrete and the like, comprising a body having a plurality of eccentrically mounted cam rollers which are adapted to be pivoted into a gripping engagement with a reinforcement bar when the driver is rotated in one direction and to be released from the bar and moved back into a retracted position when the driver is rotated in the other direction.

3 Claims, 4 Drawing Figures

DRIVER FOR REINFORCEMENT BAR CHEMICAL ANCHOR

BACKGROUND OF THE INVENTION

1. Technical Field

The field of art to which this invention pertains may be generally located in the class of devices relating to tools for installing rods, studs, and the like. Class 81, entitled Tools, United States Patent Office Classification, and in particular Subclass 53.2, appears to be the applicable general area of art to which the subject matter similar to this invention has been classified in the past.

2. Background Information

It is known in the construction art to employ reinforcement steel bars or anchors in holes formed in concrete, masonry, rock or the like, and to secure the reinforcement steel bars or anchors in place by a chemical adhesive material. Heretofore, one method employed for inserting a steel reinforcement bar or anchor into a hole in concrete was to place a breakable capsule filled with a chemical adhesive into the hole and then pound the reinforcement bar or anchor into the hole. A disadvantage of the method of pounding a reinforcement bar or anchor into a hole is that the capsule material is merely compacted into the hole and the chemical adhesive stays mostly in the bottom of the hole in the concrete or the like. Another method of installing a reinforcement bar in a hole in concrete and the like is to install a wrench over the free end of the bar and use a plurality of set screws to hold the wrench on the bar, and then rotate the wrench to turn the bar into the hole. A disadvantage of the last described bar installation method is that it is time consuming and costly, laborwise. A method of installing a threaded stud or anchor in a hole in concrete or the like, is shown in U.S. Pat. No. 4,404,875. A disadvantage of the drive unit of U.S. Pat. No. 4,404,875 is the fact that much time is lost on the job in having to manually release the drive unit with a pair of wrenches. The wrenches also comprise extra tools which must be employed in the use of the last mentioned drive unit.

U.S. Pat. Nos. 2,336,157, 2,933,960, 3,280,666, and 4,513,643 illustrate further examples of prior art tools for installing threaded studs and similar elements.

SUMMARY OF THE INVENTION

In accordance with the invention, a driver is provided for rotatably driving a construction reinforcement bar into a seating position in a hole in concrete, masonry, rock or the like, and into engagement with a capsule, which carries a chemical adhesive, for breaking the capsule and distributing the adhesive throughout the length of the hole. The driver includes a body having a top end portion and a lower end portion which is provided with a transverse bottom end surface. A plurality of cam rollers are eccentrically mounted on pivot pins disposed in equally spaced apart annular positions on the bottom end surface of the body lower end portion. The body has an axial bore formed therein which extends axially inward from the bottom end surface of the lower end portion thereof, for the slidable reception of one end of a reinforcement bar. The driver is adapted to be releasably secured by a suitable attachment means to a power drive means for rotating the driver. When the driver is rotated in one direction the eccentrically mounted cam rollers are each pivoted from a retracted position toward a reinforcement bar received in the body axial bore and into an advanced driving engagement position with the bar, and when the driver is rotated in the other direction the eccentrically mounted cam rollers are pivoted away from the reinforcement bar and back to their retracted positions to release the driving engagement of the cam rollers with the bar. The attachment means for releasably securing the driver to a power drive means includes a drive shaft mounted in an axial hole in the body top end portion and a retainer pin operatively mounted in a transverse hole formed through the body top end portion and in an aligned transverse hole formed through the drive shaft, and a means for releasably holding the retainer pin in the transverse holes.

DESCRIPTION OF THE PREFERRED EMBODIMENT

Figure 1:
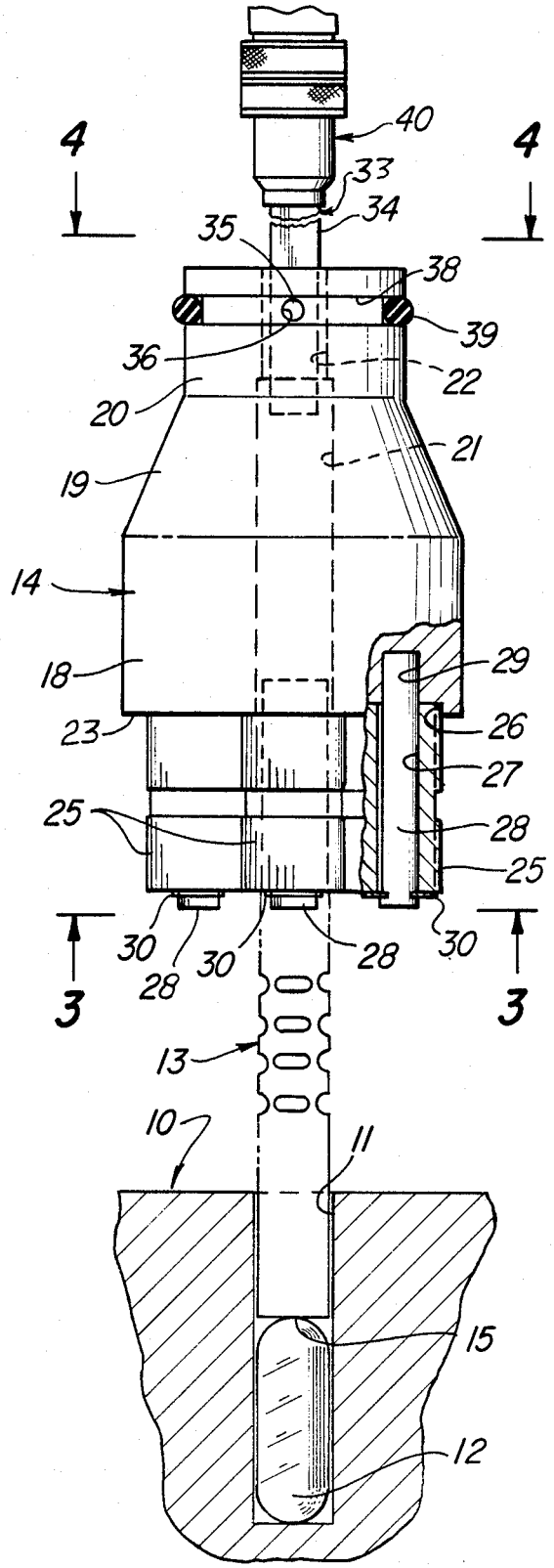
FIG. 1 is an elevation view, with parts broken away, of a driver for a reinforcement bar chemical anchor, made in accordance with the principles of the present invention, and showing the driver attached to one end of a construction reinforcement bar. The bar is shown partially inserted into a drilled hole in a concrete material, with the lower end of the anchor abutting a breakable capsule which carries a chemical adhesive material, and which is seated in the bottom of the hole.

Referring now to the drawings, and in particular to FIG. 1, the numeral 10 generally designates a concrete member which has formed therein a drilled hole 11, in which is partially mounted the lower end of a construction reinforcement bar or anchor, generally indicated by the numeral 13. The numeral 12 designates a breakable capsule carrying a chemical adhesive material. The construction reinforcement bar 13 is of a conventional type which has a roughened outer surface, and the lower end thereof is indicated by the numeral 15.

The numeral 14 generally designates a driver made in accordance with the principles of the present invention. As shown in FIG. 1, the driver 14 has a body comprising a lower end portion 18, an intermediate truncated conical portion 19, and a top end portion cylindrical portion 20. The driver 14 is provided with an axial cylindrical bore 21 which extends upwardly from the lower bottom end surface 23 into the body top end cylindrical portion 20. The upper end of the axial bore 21 communicates an axial square hole 22 which extends through the top end cylindrical portion 20 of the driver body.

Figure 3:
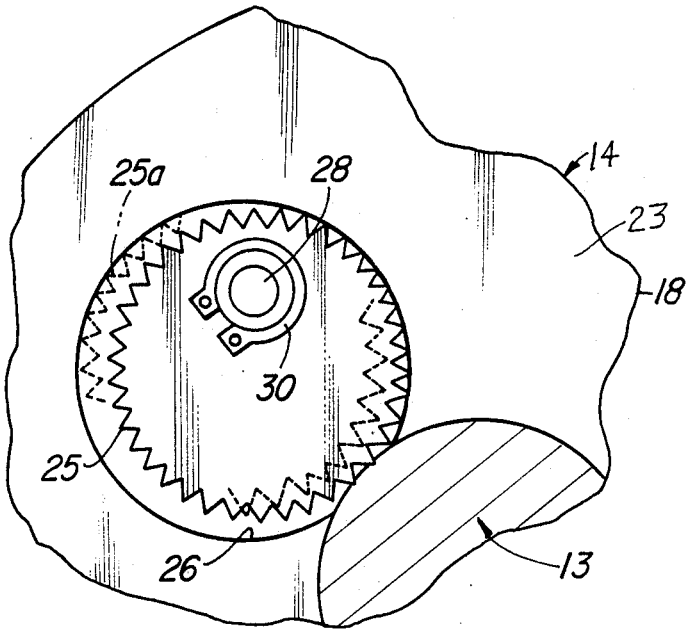
FIG. 3 is a fragmentary, enlarged bottom view of the driver illustrated in FIG. 1, taken along the line 3—3 thereof, and looking in the direction of the arrows.

As shown in FIG. 1, the driver 14 is provided with three eccentrically mounted cam rollers 25 on the lower end thereof. Each of the cam rollers 25 are provided with straight knurled peripheries, as illustrated in FIG. 3.

Figure 2:
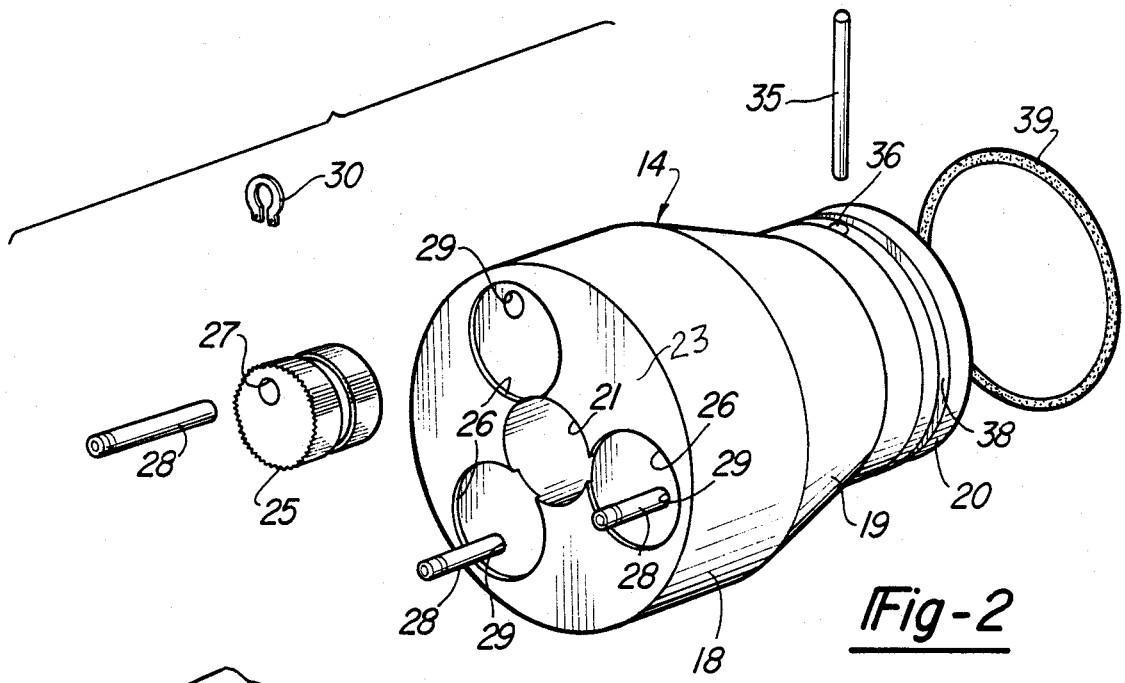
FIG. 2 is an exploded, perspective view of the driver illustrated in FIG. 1, and showing the method of assembly of the various parts of the driver.

As shown in FIG. 2, three counter bores 26 are formed in the bottom end surface 23 of the driver body lower end portion 18. The counter bores are annularly and equally spaced apart from each other. A pivot pin hole 29 is formed in the driver lower end portion 18, within each of the counter bores 26, but they are mounted in a position eccentric to the center line of the counter bores 26, although they are mounted in equally spaced apart positions annularly around the lower end surface 23 of the driver body lower end portion 18. The cam rollers 25 are each mounted in one of counter bores 26 by a pivot pin 28 which extends through an eccentrically formed hole 27 in each of the respective cam rollers 25. The inner ends of the pivot pins 28 are press fitted into the pivot pin holes 29 which are disposed parallel to the bore 21. As illustrated in FIG. 3, each of the cam rollers 25 is retained against axial movement on its respective pivot pin 28 by a suitable retainer clip 30.

Figure 4:
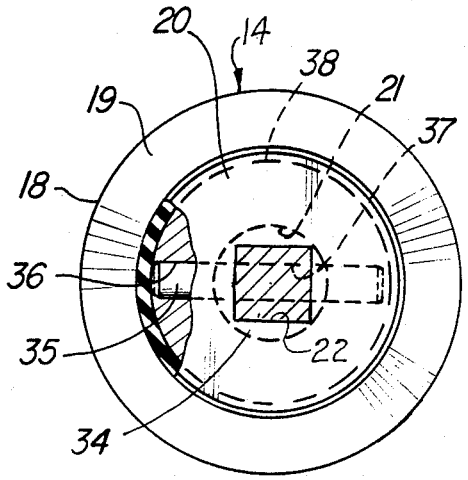
FIG. 4 is a top plan view of the driver illustrated in FIG. 1, taken long the line 4—4 thereof, and looking in the direction of the arrows.

As shown in FIGS. 1 and 4, the square end 34 of a suitable drive shaft, generally indicated by the numeral 33, is slidably mounted in the axial square hole 22 in the body top end cylindrical portion 20. The drive shaft square end 34 is retained in place in the driver body top end cylindrical portion 20 by a suitable transverse retainer pin 35 which is operatively mounted through a transverse bore 36 in the driver body top end portion 20, and an aligned transverse bore 37 in the shaft drive square end 34. The retainer pin 35 is held in an operative retaining position, as shown in FIGS. 1 and 4, by means of a suitable O-ring 39 which is disposed around the periphery of the driver body top end portion 20 and is seated in a peripheral groove 38 which communicates with the transverse bore 36 in the driver body top end portion 20. As shown in FIG. 1, the upper end of the drive shaft 33 would be operatively attached to a power drive means such as a drill 40. The drive shaft 33 could also be rotated by a suitable air driven power unit, an impact wrench, or the like.

In use, a breakable capsule 12, carrying a chemical adhesive material, is placed into a drilled hole 11, which has been cleaned of all dirt and dust. The hole 11 is drilled to an appropriate depth and the diameter of the hole 11 corresponds to the diameter of a reinforcement bar 13. The reinforcement bar 13 is positioned with its lower end in the upper end of the hole 11, and the driver 14 is moved downwardly in a vertical direction over the upper end of the reinforcement bar 13, as illustrated in FIG. 1. The cam rollers 25 are in an initial retracted position, as indicated by the broken line positio **25*a* in FIG. 3, whereby when the driver 14 is rotated in a clockwise direction, as viewed from the top of the driver, as in FIG. 4, the cam rollers 25 will pivot inwardly by centrifugal force to advanced positions to engage the outer surface of the reinforcement bar 13 in a gripping engagement with the reinforcement bar 13. Continued simultaneous downward pressure and rotation of the driver 14 by the power means 40 will cause the bar 13 to be quickly and easily driven into the hole 11, and into a fully seated position, whereby the capsule 12 is broken and the adhesive chemical in the capsule is distributed upwardly in the hole 11 to provide a uniform distribution of the chemical adhesive throughout the length of the hole 11. The reinforcement bar 13 is thus fixedly secured in position in the hole 11 by the chemical adhesive and the bar 13 is ready for its intended use. Rotation of the driver 14 in a counter-clockwise or reverse direction automatically releases the cam rollers 25 from a gripping position with the upper end of the bar 13, and the cam rollers 25 are automatically moved to the retracted position 25*a* shown in FIG. 3 by centrifugal force. The walls of the counter bores 26 in the driver bottom end face 23 function as stop members to stop the cam rollers 25 in their retracted positions, indicated by the numeral 25*a* in FIG. 3. The driver 14** may be made to any desired size to drive various sizes of reinforcement bars.

What is claimed is:

1. A driver for a construction reinforcement bar that is to be rotatably driven into a hole in concrete, masonry, rock or the like, and into engagement with a breakable capsule disposed in said hole and carrying a chemical adhesive, comprising:

(a) a body having a top end cylindrical portion, and a lower end cylindrical portion provided with a transverse bottom end surface;

(b) a plurality of cam rollers eccentrically mounted on pivot pins disposed in equally spaced apart annular positions on the bottom end surface of the body lower end portion, and the cam rollers having knurled peripheries;

(c) said body having an axial bore formed therein and extending axially inward from the bottom end surface of the lower end portion thereof, for the slidable reception of one end of a reinforcement bar;

(d) attachment means for releasably securing the driver to a power drive means for rotating the driver, whereby when the driver is rotated in a clockwise direction, viewed from the top of the driver, the eccentrically mounted cam rollers are pivoted by centrifugal force from respective retracted positions toward a reinforcement bar received in the body axial bore, and the cam rollers are advanced into gripping and driving engagement positions therewith, and when the driver is rotated in a counter-clockwise direction the eccentrically mounted cam rollers are pivoted by centrifugal force away from the reinforcement bar and back to their retracted positions to release the gripping and driving engagement of the cam rollers with the bar, and, (e) means for stopping the cam rollers in their retracted positions comprising a plurality of counter bores, formed in said transverse bottom end surface, and which counter bores each has an axially disposed peripheral wall, and each of said cam rollers is pivotally mounted in one of said counter bores and is stopped during its pivotal movement away from the reinforcement bar in a retracted position by engagement with the peripheral wall in its respective counter bore.

2. A driver for a construction reinforcement bar, as defined in claim 1, wherein said attachment means includes:

(a) a drive shaft mounted in an axial hole in the body top end portion, and a retainer pin operatively mounted in a transverse hole formed through the body top end portion and in an aligned transverse hole formed through the drive shaft; and, (b) means for releasably holding said retainer pin in said transverse holes.

3. A driver for a construction reinforcement bar, as defined in claim 2, including:

(a) said means for releasably holding the retainer pin in said transverse holes comprises a flexible O-ring seated in a circumferential groove formed around the body top end portion and communicating with the ends of the transverse hole through the body top end portion.

* * * * *